US011270647B2

(12) United States Patent
Shi

(10) Patent No.: US 11,270,647 B2
(45) Date of Patent: Mar. 8, 2022

(54) EXTERNAL COMPENSATION GATE DRIVER ON ARRAY (GOA) CIRCUIT AND DISPLAY PANEL

(71) Applicant: SHENZHEN CHINA STAR OPTOELECTRONICS SEMICONDUCTOR DISPLAY TECHNOLOGY CO., LTD., Guangdong (CN)

(72) Inventor: Longqiang Shi, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 168 days.

(21) Appl. No.: 16/645,864

(22) PCT Filed: Feb. 25, 2020

(86) PCT No.: PCT/CN2020/076536
§ 371 (c)(1),
(2) Date: Mar. 10, 2020

(87) PCT Pub. No.: WO2021/142887
PCT Pub. Date: Jul. 22, 2021

(65) Prior Publication Data

US 2021/0407422 A1 Dec. 30, 2021

(30) Foreign Application Priority Data

Jan. 15, 2020 (CN) ..... 202010039999.6

(51) Int. Cl.
*G09G 3/3266* (2016.01)

(52) U.S. Cl.
CPC ..... *G09G 3/3266* (2013.01); *G09G 2310/062* (2013.01)

(58) Field of Classification Search
CPC ..... G09G 2310/0286; G09G 3/3266
See application file for complete search history.

(56) References Cited

U.S. PATENT DOCUMENTS 10,242,631 B1 3/2019 Wang et al.
2014/0139510 A1* 5/2014 Han ..... G09G 3/3291 345/212

(Continued)

FOREIGN PATENT DOCUMENTS

CN 107369421 A 11/2017
CN 108877659 A 11/2018

(Continued)

OTHER PUBLICATIONS

Liuqi Zhang, Baixiang Han, Nie Chenglei, Xue Yan, Gray Chaw, Lin Xinnan: Research of a Novel Gate Driver Circuit Design for Suppressing Current Ripple of AMOLED Display, Optoelectronic Technology, Dec. 31, 2019.

(Continued)

*Primary Examiner* — Koosha Sharifi-Tafreshi

(57) ABSTRACT

The present invention discloses an external compensation GOA circuit and a display panel. By adding a random detection signal output branch, a first output waveform of a scan signal line fulfilling normal driving is outputted in a normal time, and a second output waveform of the scan signal line fulfilling blanking time random detection is outputted in a blanking time, such that randomly detecting a threshold voltage of the drive transistor by using the blanking time of the scan signal can be achieved to further achieve external real time compensation of the threshold (Continued)

voltage shift, enhance uniformity of screen image display, and improve a lifespan of the display panel.

20 Claims, 6 Drawing Sheets

(56) References Cited

U.S. PATENT DOCUMENTS

| | | | | |
|---|---|---|---|---|
| 2015/0049075 | A1* | 2/2015 | Lim | G09G 5/397 345/212 |
| 2015/0109278 | A1* | 4/2015 | Kim | G09G 3/3266 345/211 |
| 2016/0133184 | A1 | 5/2016 | Gupta et al. | |
| 2017/0162122 | A1 | 6/2017 | In | |
| 2020/0043564 | A1 | 2/2020 | Li et al. | |
| 2020/0357342 | A1 | 11/2020 | Feng et al. | |
| 2021/0027712 | A1* | 1/2021 | Kim | G09G 3/3266 |

FOREIGN PATENT DOCUMENTS

| | | | |
|---|---|---|---|
| CN | 109599144 | A | 4/2019 |
| CN | 109935188 | A | 6/2019 |
| CN | 110114817 | A | 8/2019 |

OTHER PUBLICATIONS

Baixiang Han, Yan Xue, Yongliang Huang, Liuqi Zhang, Xiang Xiao: Design of a IGZO TFT-based GOA circuit for external compensation pixel circuits, 2018 9th International Conference on Computer Aided Design for Thin-Film Transistors (CAD-TFT), Nov. 18, 2018.

* cited by examiner

EXTERNAL COMPENSATION GATE DRIVER ON ARRAY (GOA) CIRCUIT AND DISPLAY PANEL

FIELD OF INVENTION

The present invention relates to a field of display technologies, especially relates to an external compensation gate driver on array (GOA) circuit and a display panel.

BACKGROUND OF INVENTION

Active matrix organic light emitting diode (AMOLED) display devices display devices using current driving OLED devices to emit light to form screen images. Serving as a new generation of display technologies, the AMOLED has higher contrast, a faster response time and a wider angle of view, is therefore extensively applied in the field of smart phones, and is constantly developed and expanded to fields of smart televisions and wearable devices.

For driving manners, the AMOLED belongs to a current-driving device, is sensitive to electrical variation of a thin film transistor (TFT). A shift of a threshold voltage (Vth) of the TFT would influence uniformity and accuracy of screen image display. The AMOLED employs external compensation to mitigate the shift of the threshold voltage of the TFT. One way of external compensation is real time compensation, in other words, a blanking time of a scan signal is used to randomly switch on the scan signal G(n) of a row, the system starts to detect a threshold voltage of the drive transistor and further implements compensation.

SUMMARY OF INVENTION

Technical Issue

With reference to FIGS. 1A to 1B, wherein FIG. 1A is a circuit diagram of a conventional three-transistors-one-capacitor (3T1C) external compensation GOA circuit, and FIG. 1B is a scan signal output waveform diagram of a conventional GOA circuit required for external real time compensation of an active matrix organic light emitting diode (AMOLED). An array substrate row driving gate driver on array (GOA) technology functions to output a scan signal G(n) waveform.

With reference to FIG. 1A, in a conventional 3T1C external compensation circuit, all of three TFTs employ n-type TFTs. A first transistor T1 is a drive transistor, a gate electrode thereof is electrically connected to a first node Q, a drain electrode thereof receives a direct current positive voltage VDD, and a source electrode thereof is electrically connected to a second node P. A gate electrode of a second transistor T2 receives a scan signal G(n), a drain electrode thereof is connected to a data signal line (Data) 11 to receive a data voltage Vdata, a source electrode thereof is electrically connected to the first node Q. A gate electrode of a third transistor T3 receives a scan signal G(n), a drain electrode thereof is connected to a sense signal line (Sense) 12 to receive a sensing signal, and a source electrode thereof is electrically connected to the second node P. A capacitor $C_{st}$ is electrically connected between the first node Q and the second node P. An anode of the light emitting diode D1 is electrically connected to the second node P, and a cathode thereof is connected to a direct current negative voltage VSS.

With reference to FIG. 1B, wherein G(n) indicates a random output waveform of a $n^{th}$ row of scan signal lines (Gate), G(n+1) indicates an output waveform of a (n+1) row of the scan signal lines, G(n+2) indicates an output waveform of a $(n+2)^{th}$ row scan signal line. In a time of a frame A0, an output waveform of G(n) includes an output waveform portion A1 of a normal time and an output waveform portion A2 of a blanking time.

Because of external real time compensation of the AMOLED threshold voltage shift, it is required to use a blanking time of the scan signal to randomly switch on the scan signal G(n) of one row, the system starts to detect a threshold voltage of the drive transistor to further implement compensation. Therefore, enabling the output waveform of the GOA circuit to simultaneously fulfill the waveform output of normal driving and the waveform output of blanking time random detection becomes an urgent issue for achievement of external real time compensation of the AMOLED threshold voltage shift to be solved.

Technical Solution

The present invention embodiment provides an external compensation gate driver on array (GOA) circuit and a display panel that are able to make an output waveform of the GOA circuit simultaneously fulfill the waveform output of normal driving and the waveform output of blanking time random detection.

The present invention embodiment provides an external compensation gate driver on array (GOA) circuit, comprises a plurality of GOA units in cascade; wherein a $n^{th}$ GOA unit of the GOA units comprises: a scan signal output branch configured to receive a $(n-p)^{th}$ scan signal (G(n−p)), clock signal (CK) and a blank signal (BLANK) to output a first output waveform of a $n^{th}$ scan signal (G(n)) under control of the clock signal (CK) and to switch between a working status and a non-working status under control of the blank signal (BLANK), wherein the first output waveform is configured to drive a $n^{th}$ horizontal scan line, wherein, both the n and the p are natural numbers, and n>p; the scan signal output branch comprising a work mode switching module configured to control the scan signal output branch to enter the non-working status under control of a first potential of the blank signal (BLANK) and to control the scan signal output branch to enter the working status under control of a second potential of the blank signal (BLANK); and a random detection signal output branch configured to receive the $(n-p)^{th}$ scan signal (G(n−p)), a triggering signal (LSP), a first control signal (RM) and a second control signal (ST) to enter the working status and store a first potential of the $(n-p)^{th}$ scan signal (G(n−p)) under triggering of the triggering signal (LSP), to output a second output waveform of the $n^{th}$ scan signal (G(n)) under control of the first control signal (RM), and to enter the non-working status under control of the second control signal (ST), wherein the second output waveform is configured to randomly detect a threshold voltage shift of a drive transistor of the $n^{th}$ GOA unit; wherein the random detection signal output branch comprises: a triggering module, a first control module, and a second control module; and wherein the triggering module is electrically connected to a second node (M(n)), configured to receive the $(n-p)^{th}$ scan signal (G(n−p)) and the triggering signal (LSP), and is configured to store the first potential of the $(n-p)^{th}$ scan signal (G(n−p)) in the second node (M(n)); the first control module is electrically connected to a third node (P(n)), the third node (P(n)) is couple to the second node (M(n)) to obtain a potential stored by the second node (M(n)), the first control module is also configured to receive the first control signal (RM), and is configured to output the potential obtained by the third node (P(n)) to serve as the second output waveform; the second control module is electrically connected to the third node (P(n)), is configured to receive the second control signal (ST), and is configured to pull down a potential of the third node (P(n)).

The present invention embodiment also provides an external compensation gate driver on array (GOA) circuit, comprises a plurality of GOA units in cascade; wherein a $n^{th}$ GOA unit of the GOA units comprises: a scan signal output branch configured to receive a $(n-p)^{th}$ scan signal (G(n−p)), clock signal (CK) and a blank signal (BLANK) to output a first output waveform of a $n^{th}$ scan signal (G(n)) under control of the clock signal (CK) and to switch between a working status and a non-working status under control of the blank signal (BLANK), wherein the first output waveform is configured to drive a $n^{th}$ horizontal scan line, wherein, both the n and the p are natural numbers, and n>p; and a random detection signal output branch configured to receive the $(n-p)^{th}$ scan signal (G(n−p)), a triggering signal (LSP), a first control signal (RM) and a second control signal (ST) to enter the working status and store a first potential of the $(n-p)^{th}$ scan signal (G(n−p)) under triggering of the triggering signal (LSP), to output a second output waveform of the $n^{th}$ scan signal (G(n)) under control of the first control signal (RM), and to enter the non-working status under control of the second control signal (ST), wherein the second output waveform is configured to randomly detect a threshold voltage shift of a drive transistor of the $n^{th}$ GOA unit.

The present invention embodiment also provides a display panel comprising: an array substrate, comprising an external compensation gate driver on array (GOA) circuit, wherein the external compensation GOA circuit comprises a plurality of GOA units in cascade; wherein a $n^{th}$ GOA unit of the GOA units comprises: a scan signal output branch configured to receive a $(n-p)^{th}$ scan signal (G(n−p)), clock signal (CK) and a blank signal (BLANK) to output a first output waveform of a $n^{th}$ scan signal (G(n)) under control of the clock signal (CK) and to switch between a working status and a non-working status under control of the blank signal (BLANK), wherein the first output waveform is configured to drive a $n^{th}$ horizontal scan line, wherein, both the n and the p are natural numbers, and n>p; and a random detection signal output branch configured to receive the $(n-p)^{th}$ scan signal (G(n−p)), a triggering signal (LSP), a first control signal (RM) and a second control signal (ST) to enter the working status and store a first potential of the $(n-p)^{th}$ scan signal (G(n−p)) under triggering of the triggering signal (LSP), to output a second output waveform of the $n^{th}$ scan signal (G(n)) under control of the first control signal (RM), and to enter the non-working status under control of the second control signal (ST), wherein the second output waveform is configured to randomly detect a threshold voltage shift of a drive transistor of the $n^{th}$ GOA unit.

Advantages

The external compensation GOA circuit of the present invention, by adding the random detection signal output branch, is capable of outputting the first output waveform from the scan signal line for satisfying normal driving in a normal time, and is capable of outputting the second output waveform from the scan signal line in a blanking time for satisfying random detection such that randomly detecting a threshold voltage of the drive transistor by using the blanking time of the scan signal can be achieved to further achieve external real time compensation of the threshold voltage shift, enhance uniformity of screen image display, and improve a lifespan of the display panel.

DESCRIPTION OF DRAWINGS

To more clearly elaborate on the technical solutions of embodiments of the present invention or prior art, appended figures necessary for describing the embodiments of the present invention or prior art will be briefly introduced as follows. Apparently, the following appended figures are merely some embodiments of the present invention. A person of ordinary skill in the art may obtain other figures according to the appended figures without any creative effort.

DETAILED DESCRIPTION OF PREFERRED EMBODIMENTS

Figure 1A:
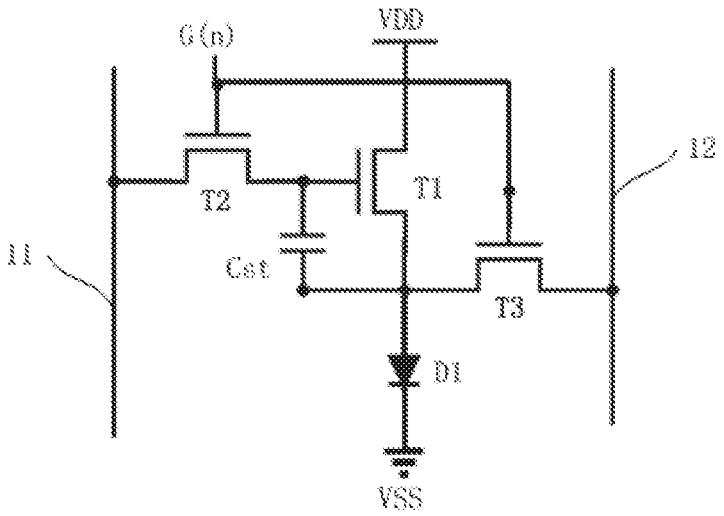
FIG. 1A PRIOR ART
FIG. 1A is a circuit diagram of a conventional three-transistors-one-capacitor (3T1C) external compensation GOA circuit.
Figure 1B:
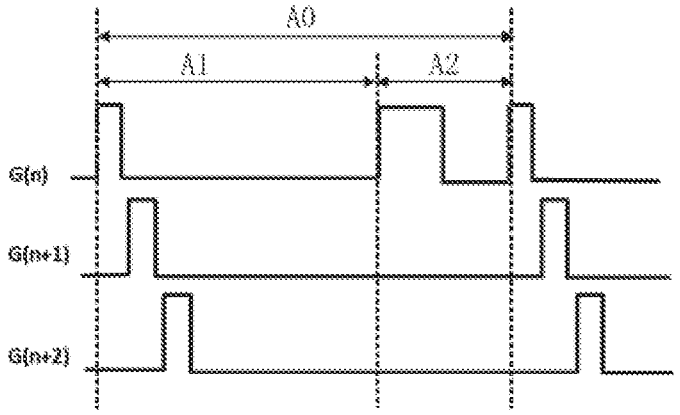
FIG. 1B PRIOR ART
FIG. 1B is a scan signal output waveform diagram of a conventional GOA circuit required for external real time compensation of an active matrix organic light emitting diode (AMOLED)

Embodiments of the present invention will be described in details. Examples of the embodiments are illustrated in the accompanying drawings. The same or similar reference characters refer to the same or similar elements or elements including the same or similar functions. The specification and claims of the present invention and terminologies "first", "second", "third", etc. (if existing) in the above accompanying drawings are configured to distinguish similar objects and are not configured to describe a specific sequence or order thereof. It should be understood that such described objects can be exchanged with one another in an adequate condition. Furthermore, terminologies "include", "have" and any variant thereof are intended to inclusive inclusion instead of exclusive inclusion. Directional terminologies mentioned by the present invention, for example "upper", "lower", "front", "rear", "left", "right", "top", "bottom", etc., only refer to directions of the accompanying drawings.

In the description of the present invention, it should be noted that unless clear rules and limitations otherwise exist, terminologies "install", "connect", "connection" should be understood in a broad sense. For instance, the connection can be a fixed connection, a detachable connection or an integral connection. The connection can be a mechanical connection, an electrical connection or a telecommunication. The connection can be a direct connection, an indirect connection through an intermedium, can be an internal communication between two elements or an interaction between the two elements. For a person of ordinary skill in the art, the specific meaning of the above terminology in the present invention can be understood on a case-by-case basis.

The present invention provides a new external compensation GOA circuit, and adds a random detection signal output branch on a scan signal output branch. The scan signal output branch is configured to output a normal output waveform of a scan signal line (Gate) in a normal time. The random detection signal output branch is configured to output a random detection output waveform of the scan signal line (Gate) in a blanking time. The output waveform of the GOA circuit not only fulfills a waveform output of normal driving, but also fulfills a random detection waveform output of the blanking time such that a blanking time of a scan signal is used to randomly switch on the scan signal G(n) of a row, the system starts to detect a threshold voltage of the drive transistor and further implements compensation to further achieve external real time compensation if a threshold voltage shift, improve uniformity of screen image display, and increase the lifespan of the display panel.

Figure 2:
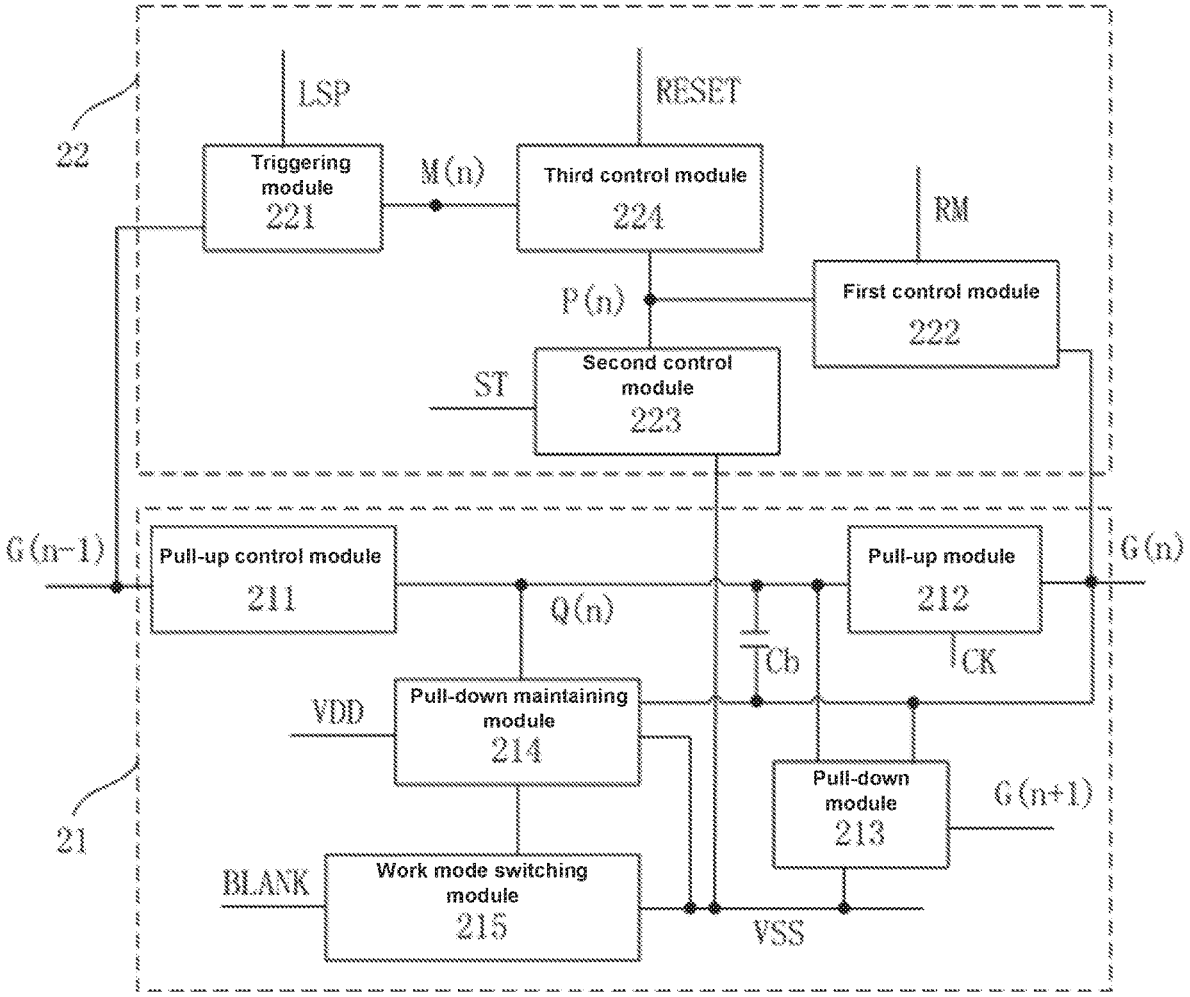
FIG. 2 is a structural view of an external compensation GOA circuit of the present invention.

With reference to FIG. 2, FIG. 2 is a structural view of an external compensation GOA circuit of the present invention. The external compensation GOA circuit of the present invention comprises a plurality of GOA units in cascade. As shown in FIG. 2, the $n^{th}$ GOA unit comprises: a scan signal output branch 21 and a random detection signal output branch 22.

The scan signal output branch 21 is configured to receive a $(n-p)^{th}$ scan signal G(n−p), a clock signal CK, and a blank signal BLANK, to output a first output waveform of a $n^{th}$ scan signal G(n) under control of the clock signal CK, and to switch between a working status and a non-working status under control of the blank signal BLANK. The first output waveform is configured to drive a $n^{th}$ horizontal scan line. Both n, p are natural numbers, and n>p.

the random detection signal output branch 22 is configured to receive the $(n-p)^{th}$ scan signal G(n−p), a triggering signal LSP, a first control signal RM, and a second control signal ST, to enter the working status and store a first potential of the $(n-p)^{th}$ scan signal G(n−p) under triggering of the triggering signal LSP, to output a second output waveform of the $n^{th}$ scan signal G(n) under control of the first control signal RM, and to enter the non-working status under control the second control signal ST, the second output waveform is configured to randomly detect a threshold voltage shift of the drive transistor of the $n^{th}$ GOA unit.

By adding the random detection signal output branch, the external compensation GOA circuit can of the present invention, in a same frame of the scan signal, output the first output waveform of the scan signal line (a waveform fulfilling normal driving) in the normal time, output the second output waveform of the scan signal line (a waveform fulfilling random detection of the blanking time) in the blanking time such that a blanking time of a scan signal is used to randomly detect a threshold voltage of the drive transistor to further implement external real time compensation of a threshold voltage shift, improve uniformity of screen image display, and increase the lifespan of the display panel.

In a further embodiment, the scan signal output branch 21 comprises: a pull-up control module 211, a pull-up module 212, a pull-down module 213, a pull-down maintaining module 214, a bootstrap capacitor Cb, and a work mode switching module 215.

The pull-up control module 211 is electrically connected to a first node Q(n), is configured to receive the $(n-p)^{th}$ scan signal G(n−p), and is configured to pull down or pull up a potential of the first node Q(n).

the pull-up module 212 is electrically connected to the first node Q(n), is configured to receive the clock signal CK, is configured to output a first output waveform (a waveform fulfilling normal driving) of the $n^{th}$ scan signal G(n) according to the clock signal CK.

The bootstrap capacitor Cb is electrically connected between the first node Q(n) and an output end of the pull-up module 212. When the pull-up module 212 outputs the first output waveform of $n^{th}$ scan signal G(n), because of bootstrap effect of the bootstrap capacitor Cb, the potential of the first node Q(n) can be further pulled up.

The pull-down module 213 is electrically connected to the first node Q(n), is configured to receive first voltage signal and $(n+p)^{th}$ scan signal G(n+p), is configured to pull down the potential of the first node Q(n) and to pull down the potential of the $n^{th}$ scan signal G(n). Specifically, the first voltage signal is a direct current negative voltage signal VSS.

the pull-down maintaining module 214 is electrically connected to the first node Q(n), is configured to receive the first voltage signal, second voltage signal and the $n^{th}$ scan signal G(n), and is configured to maintain a low potential of the first node Q(n). A potential of the second voltage signal is higher than a potential of the first voltage signal. Specifically, the second voltage signal is a direct current positive voltage signal VDD, and the first voltage signal is a direct current negative voltage signal VSS.

the work mode switching module 215 is electrically connected to the pull-down maintaining module 214, is configured to receive the first voltage signal and the blank signal BLANK, is configured to control the pull-down maintaining module 214 to stark working under control of a first potential of the blank signal BLANK such that the scan signal output branch 21 enters the non-working status, and to control the pull-down maintaining module 214 to start working under control of a second potential of the blank signal BLANK such that the scan signal output branch 21 enters the working status. Specifically, the first potential of the blank signal BLANK is higher than the second potential thereof. For example, the first potential is a high potential, and the second potential is a low potential.

In a further embodiment, the random detection signal output branch 22 comprises: a triggering module 221, a first control module 222, and a second control module 223.

The triggering module 221 is electrically connected to a second node M(n), receives the $(n-p)^{th}$ scan signal G(n−p) and the triggering signal LSP, is configured to store the first potential of the $(n-p)^{th}$ scan signal G(n−p) in the second node M(n). Specifically, the first potential of the $(n-p)^{th}$ scan signal G(n−p) is a high potential.

The first control module 222 is electrically connected to a third node P(n). The third node P(n) is couple to the second node M(n) to obtain a potential stored by the second node M(n). The first control module 222 receives the first control signal RM, is configured to output the potential obtained by the third node P(n) to serve as the second output waveform (it satisfies the waveform randomly detected in the blanking time).

The second control module 223 is electrically connected to the third node P(n), receives the second control signal ST, and is configured to pull down a potential of the third node P(n).

In a further embodiment, the random detection signal output branch 22 further comprises: a third control module 224. the third control module 224 is electrically connected between the second node M(n) and the third node P(n), is configured to receive a third control signal RESET, and is configured to transit the potential stored by the second node M(n) to the third node P(n).

Figure 3A:
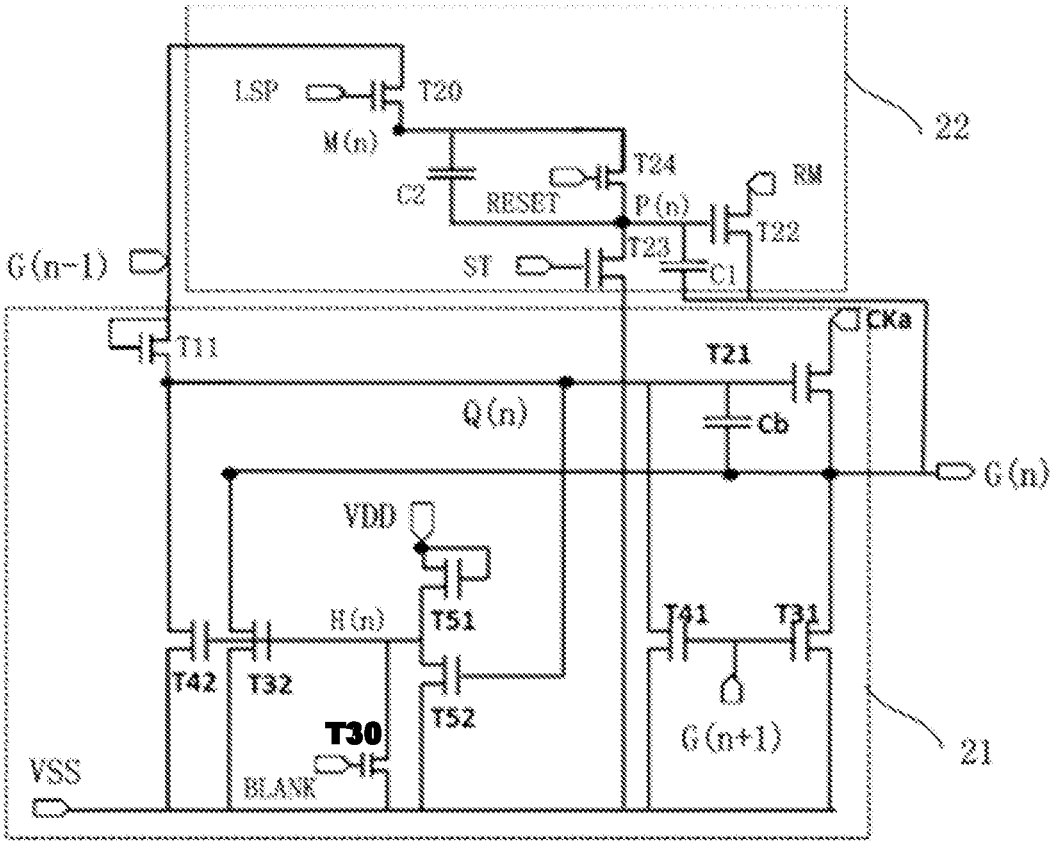
FIG. 3A is a circuit diagram of an embodiment of an external compensation GOA circuit of the present invention.
Figure 3B:
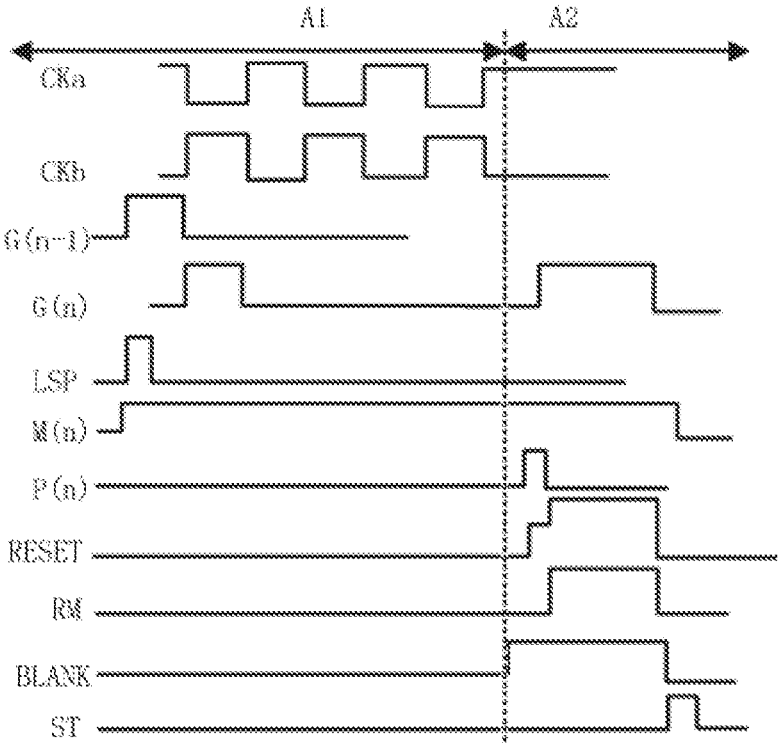
FIG. 3B is a drive timing diagram of the external compensation GOA circuit in FIG. 3A.

With reference to FIGS. 2 and 3A to 3B, FIG. 3A is a circuit diagram of an embodiment of an external compensation GOA circuit of the present invention. FIG. 3B is a drive timing diagram of the external compensation GOA circuit in FIG. 3A. a value of p in the present embodiment is 1. It should be noted that the value of p of the present embodiment is exemplary and shall not be deemed as a limitation to the present invention.

With reference to FIG. 3A, the pull-up control module 211 comprises: a pull-up control transistor T11. A gate electrode of the pull-up control transistor T11 is shorted with the first electrode, is configured to receive a $(n-1)^{th}$ scan signal G(n−1), the second electrode is electrically connected to the first node Q(n). In other words, the pull-up control transistor T11 is configured to pull up or pull down the potential of the first node Q(n) in response to the $(n-1)^{th}$ scan signal G(n−1).

the pull-up module 212 comprises: a pull-up transistor T21. A gate electrode of the pull-up transistor T21 is electrically connected to the first node Q(n), a first electrode thereof is configured to receive a clock signal CK, a second electrode thereof is configured to output a $n^{th}$ scan signal G(n). In other words, the pull-up transistor T21 is configured to output a first output waveform of the $n^{th}$ scan signal G(n) (a waveform fulfilling normal driving) under control of potential and the clock signal CK of the first node Q(n).

The bootstrap capacitor Cb is electrically connected between the first node Q(n) and a second electrode of the pull-up transistor T21. When the pull-up transistor T21 switches on, the potential of the first node Q(n) can be further increased because of bootstrap effect of the bootstrap capacitor Cb.

The pull-down module 213 comprises: a first pull-down transistor T31 and a second pull-down transistor T41. A gate electrode of the first pull-down transistor T31 is configured to receive a $(n+1)^{th}$ scan signal G(n+1), a first electrode thereof is configured to pull down the potential of the $n^{th}$ scan signal G(n), and a second electrode thereof is configured to receive a first voltage signal VSS. A gate electrode of the second pull-down transistor T41 is configured to receive the $(n+1)^{th}$ scan signal G(n+1), a first electrode thereof is configured to pull down the potential of the first node Q(n), and a second electrode thereof is configured to receive the first voltage signal VSS.

The pull-down maintaining module 214 comprises: a first transistor T32, a second transistor T42, a third transistor T51, and a fourth transistor T52. A gate electrode of the first transistor T32 is electrically connected to a fourth node H(n), a first electrode thereof is electrically connected to the second electrode of the pull-up transistor T21, and a second electrode thereof is configured to receive the first voltage signal VSS. The first transistor T32 is configured to maintain a low potential of the $n^{th}$ scan signal G(n). A gate electrode of the second transistor T42 is electrically connected to the fourth node H(n), a first electrode thereof is electrically connected to the first node Q(n), a second electrode thereof is configured to receive the first voltage signal VSS. The second transistor T42 is configured to maintain a low potential of the first node Q(n). A gate electrode of the third transistor T51 is electrically connected to the first node Q(n), a first electrode thereof is electrically connected to the fourth node H(n), a second electrode thereof is configured to receive the first voltage signal VSS. A gate electrode of the fourth transistor T52 is shorted with a first electrode thereof, is configured to receive a second voltage signal VDD, a second electrode thereof is electrically connected to the fourth node H(n). Specifically, the second voltage signal is a direct current positive voltage signal, the first voltage signal VSS is a direct current negative voltage signal. A potential of the second voltage signal VDD is higher than a potential of the first voltage signal VSS.

The work mode switching module 215 comprises: a switch transistor T30. The switch transistor T30 is configured to switch on in response to the first potential of the blank signal BLANK to control the pull-down maintaining module 214 to stop working, and to switch off in response in response to the second potential of the blank signal BLANK to control the pull-down maintaining module 214 to start working. Specifically, a gate electrode of the switch transistor T30 is configured to receive the blank signal BLANK, a first electrode thereof is electrically connected to the fourth node H(n), and a second electrode thereof is configured to receive the first voltage signal VSS.

The triggering module 221 comprises: a triggering transistor T20. The triggering transistor T20 is configured to switch on in response to a triggering signal LSP to store a first potential of a $(n-1)^{th}$ scan signal G(n−1) in a second node M(n). Specifically, a gate electrode of the triggering transistor T20 is configured to receive the triggering signal LSP, a first electrode thereof is configured to receive the $(n-1)^{th}$ scan signal G(n−1), and a second electrode thereof is electrically connected to the second node M(n).

The first control module 222 comprises: a first control transistor T22 and a first capacitor C1. The first control transistor T22 is configured to switch on in response to the first control signal RM to output the potential obtained by the third node P(n). Specifically, a gate electrode of the first control transistor T22 is electrically connected to the third node P(n), a first electrode thereof is configured to receive the first control signal RM, a second electrode thereof is configured to output the potential obtained by the third node P(n) to serve as the second output waveform (a waveform fulfilling random detection of the blanking time). The first capacitor C1 is electrically connected between the third node (P(n) and an output end of the first control transistor T22 (a second electrode thereof). When the first control transistor T22 switches on, the first capacitor C1 can further pull up the potential of the third node (P(n).

The second control module 223 comprises: a second control transistor T23. The second control transistor T23 is configured to switch on in response to the second control signal ST to pull down the potential of the third node P(n). Specifically, the second control transistor T23 的 gate electrode is configured to receive the second control signal ST, a first electrode thereof 電連 接 the third node P(n), a second electrode thereof is configured to 接收 the first voltage signal VSS.

the third control module 224 comprises: a third control transistor T24 and a second capacitor C2. the third control transistor T24 is configured to switch on in response to the third control signal RESET to transit the potential stored by the second node M(n) to the third node P(n). Specifically, a gate electrode of the third control transistor T24 is configured to receive the third control signal RESET, a first electrode thereof is electrically connected to the second node M(n), and a second electrode thereof is electrically connected to the third node P(n). the second capacitor C2 is electrically connected between the second node M(n) and a second electrode of the third control transistor T24 (the third node P(n)). When the third control transistor T24 switches on, the second capacitor C2 can further pull up the potential of the second node M(n).

In the present embodiment, transistors employed by the external compensation GOA circuit arfe N-TYPE thin film transistors (NTFTs), a drain electrode of the NTFT is a first electrode of the transistor, and a source electrode of the NTFT is a transistor second electrode.

With reference to FIGS. 3A to 3B, explanation for the work principle of the present invention external compensation GOA circuit is as follows. In FIG. 3B, CKa, CKb are opposite clock signals (alternating current), G(n) is a waveform of the $n^{th}$ scan signal G(n), G(n−1) and G(n+1) are waveforms of scan signals of a previous level and a next level of G(n), LSP is a triggering signal. RESET, BLANK, RM are control signals. M(n)/P(n) indicate waveforms of important nodes. CKa controls the waveform of G(n), and CKb controls the waveform of G(n−1). The work principle of the scan signal output branch 21 can refer to a conventional GOA circuit, and will not be described repeatedly herein.

A specific work principle of the random detection signal output branch 22 is as follows:

1) In the normal time A1, when the triggering signal LSP is in a high potential, the triggering transistor T20 switches on, a high potential of a $(n-1)^{th}$ scan signal G(n−1) is stored in the second node M(n).

2) In the blanking time A2, the blank signal BLANK variates to a high potential, the switch transistor T30 switches on such that the gate electrodes of the first transistor T32 and the second transistor T42 in the pull-down maintaining module 214 are under direct current negative voltage VSS and switch off. In the meantime, the scan signal output branch 21 enters the non-working status and would not affect operation of the random detection signal output branch 22.

3) When the third control signal RESET varies to a high potential, the third control transistor T24 switches on, a high potential of the second node M(n) is transited to the third node P(n). The third node P(n) is in a high potential such that the first control transistor T22 switches on. However, the first control signal RM is in a low potential, and $n^{th}$ scan signal G(n) outputs a low potential.

4) When the first control signal RM varies to a high potential, because coupling effect of the first capacitor C1, the potential of the third node P(n) potential further increases, and the $n^{th}$ scan signal G(n) outputs a high potential.

5) When the second control signal ST varies to a high potential, the second control transistor T23 switches on, the potential of the third node P(n) is pulled down to the direct current negative voltage VSS, and the first control transistor T22 switches off. In the meantime, the blank signal BLANK varies to a low potential, the switch transistor T30 switches off, the scan signal output branch 21 to continue to work normally, and the $n^{th}$ scan signal G(n) outputs a low potential.

Based on the same invention concept, the present invention also provides a display panel.

Figure 4:
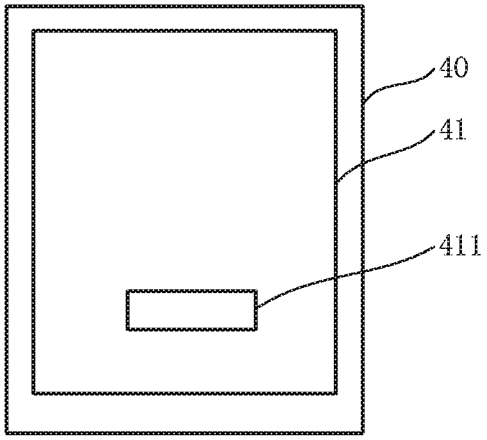
FIG. 4 is a schematic framework of a display panel of the present invention.

With reference to FIG. 4, FIG. 4 is a schematic framework of a display panel of the present invention. The display panel 40 comprises array substrate 41, the array substrate 41 comprises external compensation GOA circuit 411. The external compensation GOA circuit 411 employs the external compensation GOA circuit of FIG. 2 or 3A of the present invention. The connection method and work principle of the circuit assembly of the external compensation GOA circuit 411 have been described as above and will not be described repeatedly herein.

The display panel 40 can be an OLED display panel or AMOLED display panel.

The display panel employing external compensation GOA circuit of the present invention, in the same frame of the scan signal, a first output waveform (a waveform fulfilling normal driving) of the scan signal line can be outputted in a normal time, and a second output waveform (a waveform fulfilling random detection in the blanking time) of the scan signal line can be outputted in a blanking time. Therefore, randomly detecting a threshold voltage of the drive transistor by using the blanking time of the scan signal can be achieved to further achieve external real time compensation of the threshold voltage shift, enhance uniformity of screen image display, and improve a lifespan of the display panel.

It can be understood that for a person of ordinary skill in the art, equivalent replacements or changes can be made according to the technical solution of the present invention and its inventive concept, and all these changes or replacements should belong to the scope of protection of the appended claims of the present invention.

What is claimed is:

1. An external compensation gate driver on array (GOA) circuit, comprises a plurality of GOA units in cascade; wherein a $n^{th}$ GOA unit of the GOA units comprises:

a scan signal output branch configured to receive a $(n-p)^{th}$ scan signal (G(n−p)), clock signal (CK) and a blank signal (BLANK) to output a first output waveform of a $n^{th}$ scan signal (G(n)) under control of the clock signal (CK) and to switch between a working status and a non-working status under control of the blank signal (BLANK), wherein the first output waveform is configured to drive a $n^{th}$ horizontal scan line, wherein, both the n and the p are natural numbers, and n>p;

the scan signal output branch comprising a work mode switching module configured to control the scan signal output branch to enter the non-working status under control of a first potential of the blank signal (BLANK) and to control the scan signal output branch to enter the working status under control of a second potential of the blank signal (BLANK); and a random detection signal output branch configured to receive the $(n-p)^{th}$ scan signal (G(n−p)), a triggering signal (LSP), a first control signal (RM) and a second control signal (ST) to enter the working status and store a first potential of the $(n-p)^{th}$ scan signal (G(n−p)) under triggering of the triggering signal (LSP), to output a second output waveform of the $n^{th}$ scan signal (G(n)) under control of the first control signal (RM), and to enter the non-working status under control of the second control signal (ST), wherein the second output waveform is configured to randomly detect a threshold voltage shift of a drive transistor of the $n^{th}$ GOA unit;

wherein the random detection signal output branch comprises: a triggering module, a first control module, and a second control module; and wherein the triggering module is electrically connected to a second node (M(n)), configured to receive the $(n-p)^{th}$ scan signal (G(n−p)) and the triggering signal (LSP), and is configured to store the first potential of the $(n-p)^{th}$ scan signal (G(n−p)) in the second node (M(n)); the first control module is electrically connected to a third node (P(n)), the third node (P(n)) is couple to the second node (M(n)) to obtain a potential stored by the second node (M(n)), the first control module is also configured to receive the first control signal (RM), and is configured to output the potential obtained by the third node (P(n)) to serve as the second output waveform; the second control module is electrically connected to the third node (P(n)), is configured to receive the second control signal (ST), and is configured to pull down a potential of the third node (P(n)).

2. The external compensation GOA circuit as claimed in claim 1, wherein the scan signal output branch comprises:

a pull-up control module electrically connected to a first node (Q(n)), and configured to receive the $(n-p)^{th}$ scan signal (G(n−p)), and configured to pull down or pull up a potential of the first node (Q(n));

a pull-up module electrically connected to the first node (Q(n)), configured to receive the clock signal (CK), and configured to output the first output waveform of the $n^{th}$ scan signal (G(n)) according to the clock signal (CK);

a bootstrap capacitor electrically connected between the first node (Q(n)) and an output end of the pull-up module;

a pull-down module electrically connected to the first node (Q(n)), configured to receive a first voltage signal (VSS) and a $(n+p)^{th}$ scan signal (G(n+p)), configured to pull down the potential of the first node (Q(n)) and pull down a potential of the $n^{th}$ scan signal (G(n)); and a pull-down maintaining module electrically connected to the first node (Q(n)), configured to receive the first voltage signal (VSS), a second voltage signal (VDD), and the $n^{th}$ scan signal (G(n)), and configured to maintain a low potential of the first node (Q(n)) and maintain a low potential of the $n^{th}$ scan signal (G(n)), wherein a potential of the second voltage signal (VDD) is greater than a potential of the first voltage signal (VSS).

3. The external compensation GOA circuit as claimed in claim 1, wherein the work mode switching module comprises:

a switch transistor, the switch transistor configured to switch on in response to the first potential of the blank signal (BLANK) to control the scan signal output branch to enter the non-working status, and to switch off in response to the second potential of the blank signal (BLANK) to control the scan signal output branch to enter the working status.

4. The external compensation GOA circuit as claimed in claim 1, wherein the triggering module comprises:

a triggering transistor configured to switch on in response to the triggering signal (LSP) to store the first potential of the $(n-p)^{th}$ scan signal (G(n−p)) in the second node (M(n)).

5. The external compensation GOA circuit as claimed in claim 1, wherein the first control module comprises:

a first control transistor configured to switch on in response to the first control signal (RM) to output the potential obtained by the third node (P(n)); and a first capacitor electrically connected between the third node (P(n)) and an output end of the first control transistor.

6. The external compensation GOA circuit as claimed in claim 1, wherein the second control module comprises:

a second control transistor configured to switch on in response to the second control signal (ST) to pull down the potential of the third node (P(n)).

7. The external compensation GOA circuit as claimed in claim 1, wherein the random detection signal output branch further comprises:

a third control module electrically connected between the second node (M(n)) and the third node (P(n)), configured to receive a third control signal (RESET), and configured to transfer the potential stored by the second node (M(n)) to the third node (P(n)).

8. The external compensation GOA circuit as claimed in claim 7, wherein the third control module comprises:

a third control transistor configured to switch on in response to the third control signal (RESET) to transfer the potential stored by the second node (M(n)) to the third node (P(n)); and a second capacitor electrically connected between the second node (M(n)) and an output end of the third control transistor.

9. The external compensation GOA circuit as claimed in claim 1, wherein the first output waveform and the second output waveform are located in a same frame of the $n^{th}$ scan signal (G(n)).

10. An external compensation gate driver on array (GOA) circuit, comprises a plurality of GOA units in cascade; wherein a $n^{th}$ GOA unit of the GOA units comprises:

a scan signal output branch configured to receive a $(n-p)^{th}$ scan signal (G(n−p)), clock signal (CK) and a blank signal (BLANK) to output a first output waveform of a $n^{th}$ scan signal (G(n)) under control of the clock signal (CK) and to switch between a working status and a non-working status under control of the blank signal (BLANK), wherein the first output waveform is configured to drive a $n^{th}$ horizontal scan line, wherein, both the n and the p are natural numbers, and n>p; and a random detection signal output branch configured to receive the $(n-p)^{th}$ scan signal (G(n−p)), a triggering signal (LSP), a first control signal (RM) and a second control signal (ST) to enter the working status and store a first potential of the $(n-p)^{th}$ scan signal (G(n−p)) under triggering of the triggering signal (LSP), to output a second output waveform of the $n^{th}$ scan signal (G(n)) under control of the first control signal (RM), and to enter the non-working status under control of the second control signal (ST), wherein the second output waveform is configured to randomly detect a threshold voltage shift of a drive transistor of the $n^{th}$ GOA unit.

11. The external compensation GOA circuit as claimed in claim 10, wherein the scan signal output branch comprises:

a pull-up control module electrically connected to a first node (Q(n)), and configured to receive the $(n-p)^{th}$ scan signal (G(n−p)), and configured to pull down or pull up a potential of the first node (Q(n));

a pull-up module electrically connected to the first node (Q(n)), configured to receive the clock signal (CK), and configured to output the first output waveform of the $n^{th}$ scan signal (G(n)) according to the clock signal (CK);

a bootstrap capacitor electrically connected between the first node (Q(n)) and an output end of the pull-up module;

a pull-down module electrically connected to the first node (Q(n)), configured to receive a first voltage signal (VSS) and a $(n+p)^{th}$ scan signal (G(n+p)), configured to pull down the potential of the first node (Q(n)) and pull down a potential of the $n^{th}$ scan signal (G(n));

a pull-down maintaining module electrically connected to the first node (Q(n)), configured to receive the first voltage signal (VSS), a second voltage signal (VDD), and the $n^{th}$ scan signal (G(n)), configured to maintain a low potential of the first node (Q(n)) and maintain a low potential of the $n^{th}$ scan signal (G(n)), wherein a potential of the second voltage signal (VDD) is greater than a potential of the first voltage signal (VSS); and a work mode switching module electrically connected to the pull-down maintaining module, configured to receive the first voltage signal (VSS) and the blank signal (BLANK), configured to control the pull-down maintaining module to stop working under control of a first potential of the blank signal (BLANK) such that the scan signal output branch enters the non-working status, and to control the pull-down maintaining module to start working under control of a second potential of the blank signal (BLANK) such that the scan signal output branch enters the working status.

12. The external compensation GOA circuit as claimed in claim 11, wherein the work mode switching module comprises:

a switch transistor configured to switch on in response to the first potential of the blank signal (BLANK) to control the pull-down maintaining module to stop working, and to switch off in response to the second potential of the blank signal (BLANK) to control the pull-down maintaining module to start working.

13. The external compensation GOA circuit as claimed in claim 10, wherein the random detection signal output branch comprises:

a triggering module electrically connected to a second node (M(n)), configured to receive the $(n-p)^{th}$ scan signal (G(n−p)) and the triggering signal (LSP), and configured to store the first potential of the $(n-p)^{th}$ scan signal (G(n−p)) in the second node (M(n));

a first control module electrically connected to a third node (P(n)), wherein the third node (P(n)) is couple to the second node (M(n)) to obtain a potential stored by the second node (M(n)), and the first control module is configured to receive the first control signal (RM) and is configured to output the potential obtained by the third node (P(n)) to serve as the second output waveform; and a second control module electrically connected to the third node (P(n)), configured to receive the second control signal (ST), and configured to pull down the potential of the third node (P(n)).

14. The external compensation GOA circuit as claimed in claim 13, wherein the triggering module comprises:

a triggering transistor configured to switch on in response to the triggering signal (LSP) to store the first potential of the $(n-p)^{th}$ scan signal (G(n−p)) in the second node (M(n)).

15. The external compensation GOA circuit as claimed in claim 13, wherein the first control module comprises:

a first control transistor configured to switch on in response to the first control signal (RM) to output the potential obtained by the third node (P(n)); and a first capacitor electrically connected between the third node (P(n)) and an output end of the first control transistor.

16. The external compensation GOA circuit as claimed in claim 13, wherein the second control module comprises:

a second control transistor configured to switch on in response to the second control signal (ST) to pull down the potential of the third node (P(n)).

17. The external compensation GOA circuit as claimed in claim 13, wherein the random detection signal output branch further comprises:

a third control module electrically connected between the second node (M(n)) and the third node (P(n)), configured to receive a third control signal (RESET), and configured to transfer the potential stored by the second node (M(n)) to the third node (P(n)).

18. The external compensation GOA circuit as claimed in claim 17, wherein the third control module comprises:

a third control transistor configured to switch on in response to the third control signal (RESET) to transfer the potential stored by the second node (M(n)) to the third node (P(n)); and a second capacitor electrically connected between the second node (M(n)) and an output end of the third control transistor.

19. The external compensation GOA circuit as claimed in claim 10, wherein the first output waveform and the second output waveform are located in a same frame of the $n^{th}$ scan signal (G(n)).

20. A display panel, comprising:

an array substrate, comprising an external compensation gate driver on array (GOA) circuit, wherein the external compensation GOA circuit comprises a plurality of GOA units in cascade; wherein a $n^{th}$ GOA unit of the GOA units comprises:

a scan signal output branch configured to receive a $(n-p)^{th}$ scan signal (G(n−p)), clock signal (CK) and a blank signal (BLANK) to output a first output waveform of a $n^{th}$ scan signal (G(n)) under control of the clock signal (CK) and to switch between a working status and a non-working status under control of the blank signal (BLANK), wherein the first output waveform is configured to drive a $n^{th}$ horizontal scan line, wherein, both the n and the p are natural numbers, and n>p; and a random detection signal output branch configured to receive the $(n-p)^{th}$ scan signal (G(n−p)), a triggering signal (LSP), a first control signal (RM) and a second control signal (ST) to enter the working status and store a first potential of the $(n-p)^{th}$ scan signal (G(n−p)) under triggering of the triggering signal (LSP), to output a second output waveform of the $n^{th}$ scan signal (G(n)) under control of the first control signal (RM), and to enter the non-working status under control of the second control signal (ST), wherein the second output waveform is configured to randomly detect a threshold voltage shift of a drive transistor of the $n^{th}$ GOA unit.

* * * * *